US006341447B1

(12) United States Patent
Jean

(10) Patent No.: US 6,341,447 B1
(45) Date of Patent: Jan. 29, 2002

(54) HALF CIRCLE WINDOW SHUTTER/BLIND

(76) Inventor: Ruey-Jeng Jean, 1500 Riverview Dr., Arlington, TX (US) 76012

( * ) Notice: Subject to any disclaimer, the term of this patent is extended or adjusted under 35 U.S.C. 154(b) by 0 days.

(21) Appl. No.: 09/518,983

(22) Filed: Mar. 3, 2000

(51) Int. Cl.[7] ..... E06B 7/086
(52) U.S. Cl. ..... 49/74.1; 49/40; 160/84.07
(58) Field of Search ..... 49/74.1, 77.1, 49/87.1, 40; 160/84.07, 134; 454/221, 227, 278

(56) References Cited

U.S. PATENT DOCUMENTS

| | | | | | |
|---|---|---|---|---|---|
| 397,322 | A | * | 2/1889 | Whitaker | 49/82.1 |
| 492,671 | A | | 2/1893 | Fry | |
| 602,967 | A | | 4/1898 | Wells | |
| 842,969 | A | | 2/1907 | Osterman | |
| 1,060,187 | A | | 4/1913 | Hormel | |
| 1,411,399 | A | | 4/1922 | Beagle | |
| 1,447,189 | A | | 3/1923 | Simon | |
| 2,815,545 | A | * | 12/1957 | Green | 49/87.1 |
| 3,075,257 | A | * | 1/1963 | Rosen | 52/82 |
| 4,103,601 | A | * | 8/1978 | Dayus | 454/319 |
| 4,699,195 | A | | 10/1987 | Lester | |
| 4,709,506 | A | * | 12/1987 | Lukaszonas | 49/87.1 |
| 4,776,380 | A | | 10/1988 | Lester | |
| 4,934,434 | A | | 6/1990 | Schnebly | |
| 4,934,436 | A | | 6/1990 | Schnebly | |
| 4,936,048 | A | | 6/1990 | Ruggles | |
| 5,002,112 | A | | 3/1991 | Schnebly | |
| 5,117,889 | A | | 6/1992 | Coe | |
| 5,469,658 | A | * | 11/1995 | Digianni et al. | 49/82.1 |
| 5,471,789 | A | * | 12/1995 | Faircloth | 49/74.1 |
| 5,537,780 | A | * | 7/1996 | Cleaver et al. | 49/82.1 |
| 5,584,329 | A | * | 12/1996 | Thomas | 160/134 |
| 5,662,153 | A | * | 9/1997 | Rosenblatt | 160/84.07 |
| 5,713,156 | A | * | 2/1998 | Briggs | 49/82.1 |
| 5,765,619 | A | * | 6/1998 | Arnold | 160/84.07 |
| 5,794,680 | A | * | 8/1998 | Xue | 160/84.07 |
| 5,823,241 | A | * | 10/1998 | Sitzes et al. | 160/107 |
| 5,887,386 | A | * | 3/1999 | Alexanian et al. | 49/403 |

* cited by examiner

*Primary Examiner*—Gregory J. Strimbu
(74) *Attorney, Agent, or Firm*—Rudolf O. Siegesmund

(57) ABSTRACT

A shutter for a half-circle window having a top, a base, and a plurality of slats capable of interlocking engagement and rotatably secured between the top and the base wherein the slats are further held in position by springs providing pressure against the slats.

9 Claims, 6 Drawing Sheets

Fig. 1
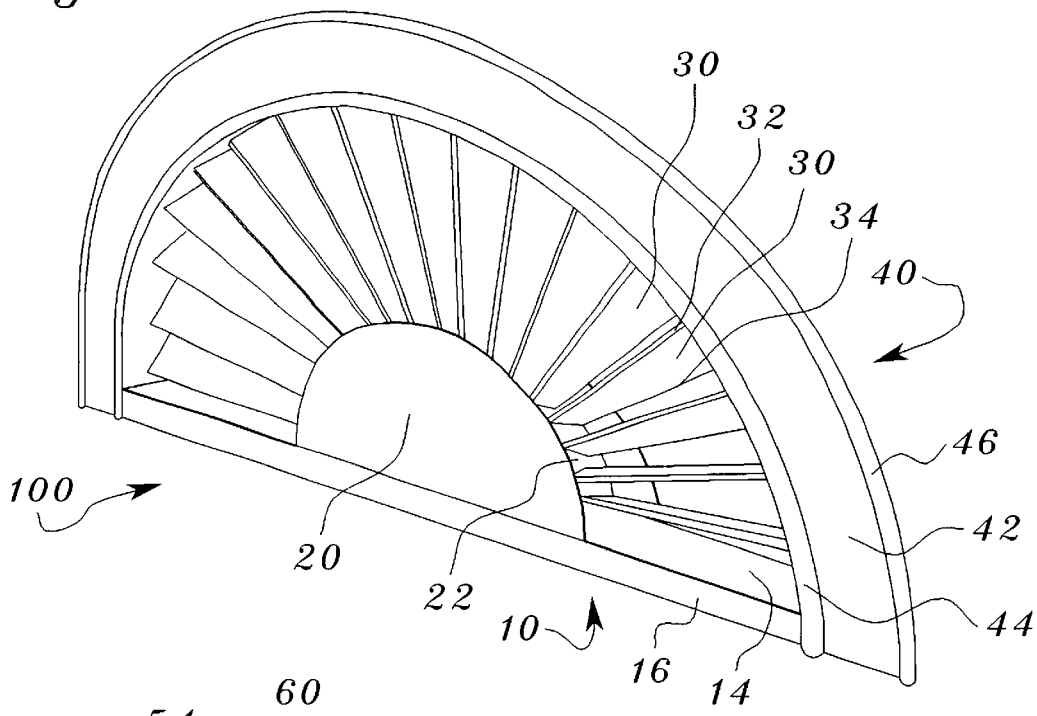
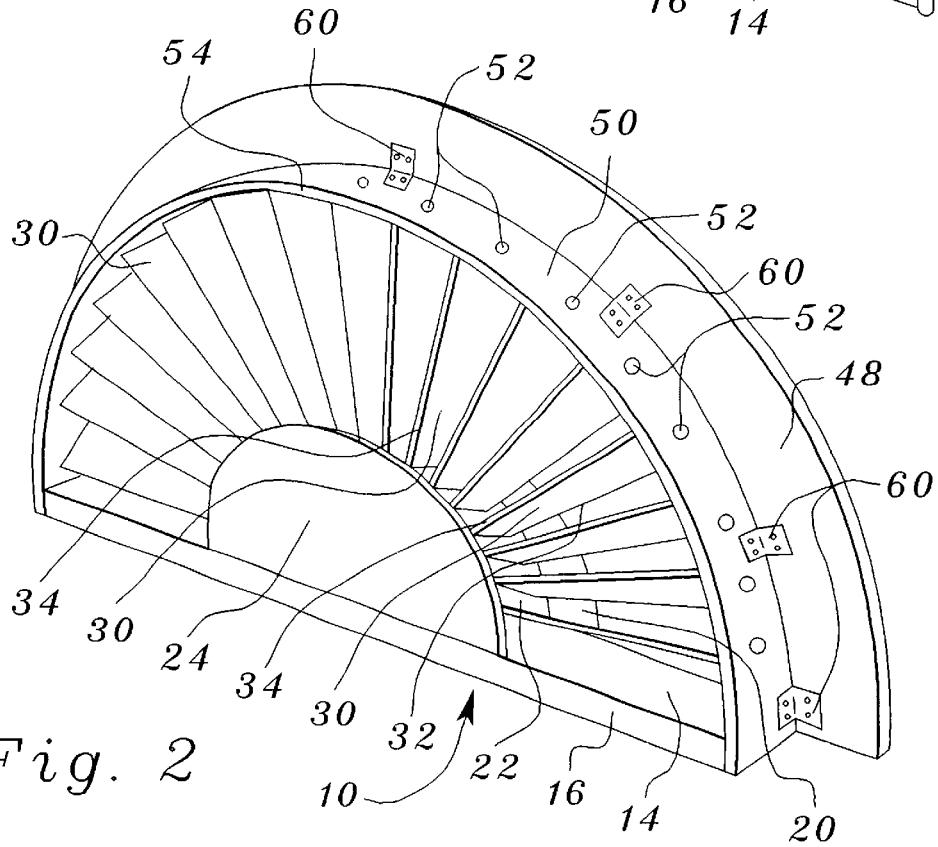
Fig. 2

Fig. 3
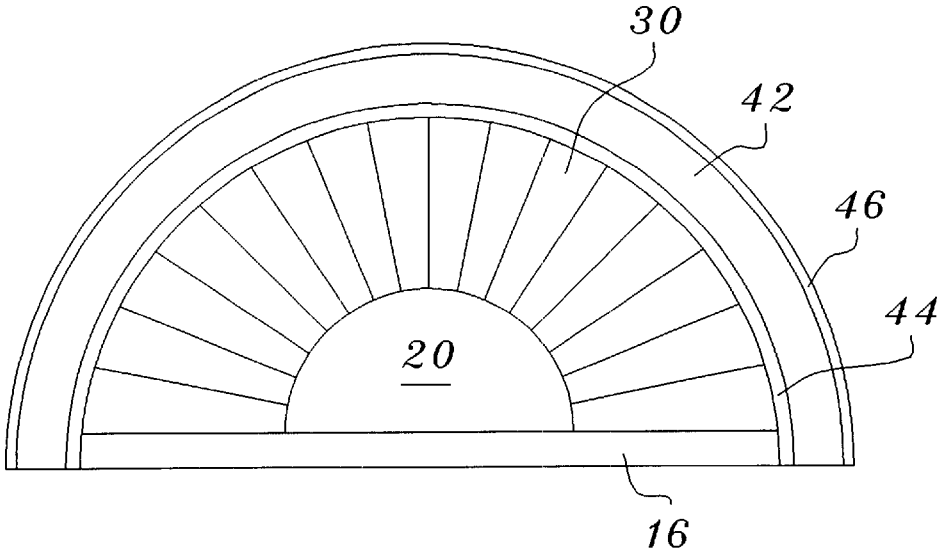
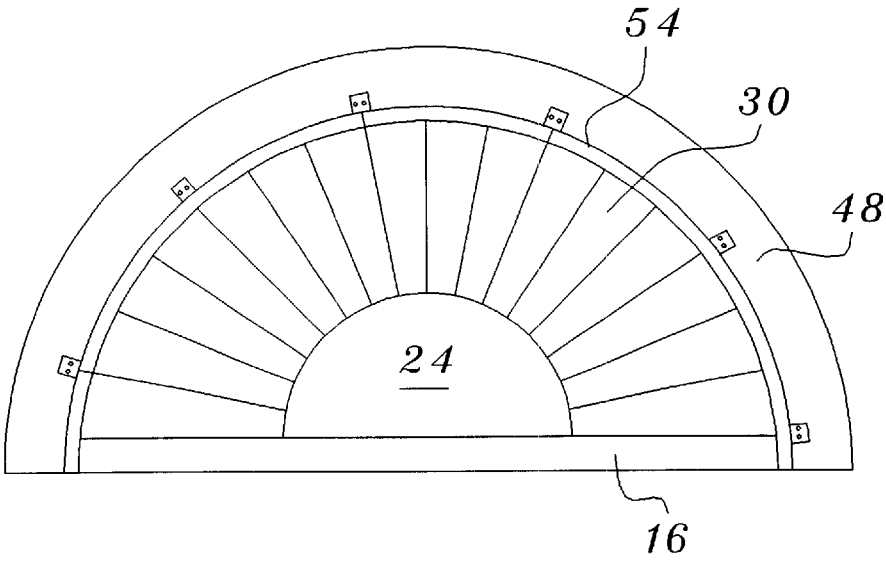
Fig. 4

HALF CIRCLE WINDOW SHUTTER/BLIND

FIELD OF THE INVENTION

The present invention relates to a shutter for a half circle or arched window in general and in particular to a spring suspension of individual slats in the shutter.

BACKGROUND OF THE INVENTION

Venetian blinds are used to prevent direct sunlight from entering a house or other building and are typically made of a number of parallel rectangular slats or blades, each of which are supported by one of the rungs of a ladder-shaped fabric segment installed at each end of the blades. Venetian blinds are therefore limited to an essentially rectangular configuration. Arched or semi-circular windows are popular in many types of architectural design creating a need for a covering to prevent the passage of direct sunlight through the window.

Shutters for half circle or arched windows present problems involving the size, shape, weight and ability to interlock of the slats which are not associated with the more common venetian blinds. The prior art involving inventions for covering circular or half-circular openings fall into two general categories. The first category utilizes blinds or slats which pivot from a common point. U.S. Pat. No. 492,671 discloses a cinder, dust and smoke excluder for car windows having beveled triangular plates which pivot like fan. U.S. Pat. No. 602,967 discloses collapsible blinds for circular or arched windows comprising two fan shaped collapsible blinds with slats pivotally connected near the center of the circle forming the arch. U.S. Pat. No. 1,060,187 discloses a wind shield for automobiles radiators having triangular blades with flaring sides which rotate from a common pivot point. U.S. Pat. No. 4,776,380 discloses two sets of blades which fan out from the ends of a U-shaped frame and meet at the top of the frame. U.S. Pat. No. 4,699,195 discloses a collapsible blind for semi-circular arched windows with tapered blades that fan out from a common axis of rotation. U.S. Pat. No. 4,934,4334, U.S. Pat. No. 4,934,436 and U.S. Pat. No. 5,002,112 disclose pleated or multi-cellular shade fabric which deploy fanlike from a common point. U.S. Pat. No. 5,117,889 discloses a blind with slats attached to a pivot bolt. U.S. Pat. No. 5,584,329 discloses a moveable shade for arched windows with triangular type blades with center ends attached pivotally at a bottom center of a window arc and outside ends rotated from the bottom outside edges of the arc to a top center of the arc.

The second category of prior art inventions for covering circular or half-circular openings involves linear pivoting. For decorative purposes, linear pivoting is most desirable because when the blades or slats are in a closed position the surface presented will be flat. By linear pivoting is meant that each blade or slat is connected to a support so that the blade or slat rotates about the axis of the two points of connection. The blades or slats must be rotatable connected to a semi-circular base and a semi-circular top support. U.S. Pat. No. 4,936,048 discloses a swivel shutter with slats pivotally mounted in a rectangular frame. U.S. Pat. No. 1,447,189 discloses linear pivoting of slats in a manner similar to the pitch adjustment of a propeller in an semi-circular frame.

The advent of lightweight materials such as foam polyvinyl chloride make the construction of lightweight shutters for arched windows possible. Likewise, composite materials such as bonded sawdust and resin provide lightweight construction materials. Additionally, both foam PVC and composite materials covered with a thin plastic skin provide materials which also allow a wide range of colors for matching to the installation site. Half-circle windows normally are installed above a rectangular window. Therefore, a further advantage of these lightweight materials and the ability to match colors is that the half circle shutter can be utilized in conjunction with either shutters or blinds on the rectangular window. The ability to match a half circle shutter with Venetian blinds as well as shutters provides for a wide range of adaptability of the arched shutter/blind. Finally, these lightweight materials allow a wide variety of prefabricated shutters for arched windows to be mass-produced thereby keeping costs down while maintaining a high quality appearance.

However, problems arise in constructing a semi-circular shutter out of such lightweight materials when linear pivoting of each slat is employed. Each slat must be anchored in a top support and a bottom support. Slats can be formed from composite materials with prongs at either end for mating with holes in the base and the top support. The first problem that arises is that, on larger shutters, the semi-circular top support can deform in handling so that the blades may become detached and fall out. For example, if the arched shutter is lifted by the top support it may deform slightly increasing the distance between the top support and bottom support to the point where the distance exceeds the length of the top prong of one or more slats. Another problem arises in keeping the tops of the blades uniformly aligned with the top support. Minor variations in the shape of the arch of the top support will be noticeable if the distance between the top of the slats and the top support varies. Moreover, such non-uniform distances will not only detract from the appearance but will also increase light leakage between the slats and the support. An additional problem that arises in mass manufacturing shutters for semi-circular windows is to increase the range of window sizes to which one shutter for a semi-circular window can be affixed. For example, the top support has a front decorative trim element that covers the space between the top support and the arch of the wall around the window to be shuttered. The wall arch is usually not geometrically perfect and can vary considerably from window to window. Thus the front decorative trim of the top support covers the intervening space. Additionally, the front decorative trim allows for a range of window sizes to be serviced by one shutter size. The larger the area of the front decorative trim the greater the range of window sizes that can be serviced by one arched shutter. A further problem in constructing arched blinds with linearly pivoting slats is to maintain a smooth surface appearance with the slats are closed while minimizing light leakage between the slats. If the slats are made to overlap they will not lie in the same plane when closed thereby distracting from the desired appearance. Finally, there exists a need for the slats to be capable of being individually turned and for each slats to remain in the position to which each individual slat has been turned. The prior art does not address these problems. Therefore, what is needed beyond the prior art is a semi-circular shutter that can be constructed of lightweight materials (1) so the slats will not fall out when the shutter is lifted or moved due to deformation of the outer frame, (2) so that light leakage between the slats and between the slats and the support will be minimized, (3) so that the shutter is adaptable to a range of arched window sizes, and (4) so that the individual slats can be turned and remain in position.

SUMMARY OF THE INVENTION

The present invention which meets the needs identified above is a shutter for half-circle window having a top, a base, and a plurality of slats capable of interlocking engagement and rotatably secured between the top and the base wherein the slats are further held in position by springs providing pressure against the slats.

The foregoing and other features and advantages of the invention will be apparent from the following more particular description of a preferred embodiment of the invention, as illustrated in the accompanying drawings wherein like reference numbers represent like parts of the invention.

BRIEF DESCRIPTION OF THE DRAWINGS

FIG. 1 depicts a right front perspective view of the apparatus.

FIG. 2 depicts a right rear perspective view of the apparatus.

FIG. 3 depicts a front view of the apparatus.

FIG. 4 depicts a rear view of the apparatus.

Figure 5:
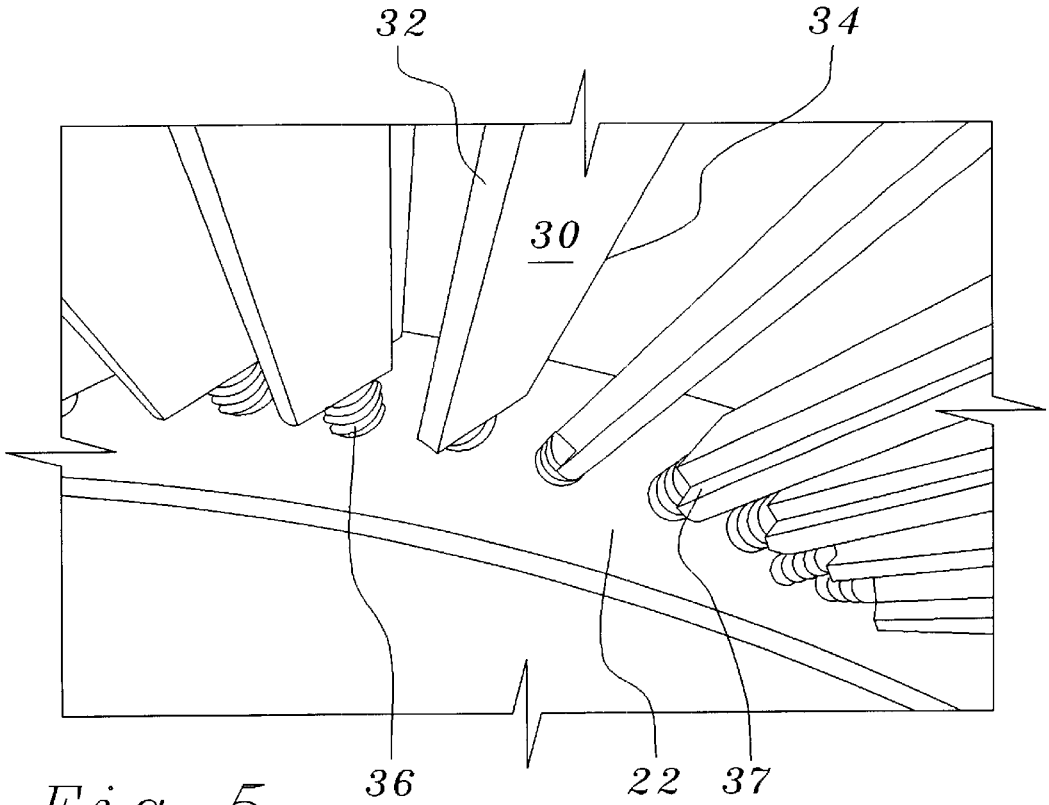
FIG. 5 depicts a detail view of the slats and base.

DETAILED DESCRIPTION OF THE PREFERRED EMBODIMENT.

FIG. 1 shows shutter 100 with base 10, top 40 and a plurality of slats 30. Base 10 has baseboard 16, base front 20, base rear 24, base slat support 22. Top 40 has outer ridge 46, top front 42 and inner ridge 44. Outer ridge 46 may be molded into top front 42 or may be fixedly attached to top front 42. Inner ridge 44 may be molded into top front 42 or may be fixedly attached to top front 42. Slats 30 have first edge 32 and second edge 34. Baseboard 16 has baseboard top surface 14.

FIG. 2 shows a rear perspective view of shutter 100. Top 40 has top rear 48 and top support 50. Base 10 has baseboard 16, base rear 24, and base slat support 22. Slats 30 have first edge 32 and second edge 34. Top rear 48 is fixedly attached to top support 50 by joints 60. In the preferred embodiment, joints 60 are thin metal sheets folded at a right angle and nailed with two nails to top rear 48 and nailed with two nails to top support 50. Alternatively, joints 60 may be affixed to top rear 48 and top support 50 by glue or adhesive. Further in the alternative, top rear 48 may be joined to top support 50 by glue or cement without joints 60. Additionally, top rear 48 and top support 50 may be molded in one piece.

FIG. 3 shows a front view of shutter 100 with slats 30 in the closed position. FIG. 3 shows the desired flat surface appearance of shutter 100 when slats 30 are in the closed position. All slats 30 lie in the same plane. Light leakage at the tops of slats 30 is minimized by the uniform closure of the tops of slats 30 with top 40. Light leakage between slats 30 is minimized by the interlocking engagement of slats 30 which will be detailed in FIGS. 5, 6 and 7. Light leakage at the bottom of slats 30 is minimized by base front 20 which, in addition to its decorative function, provides an overlap of the bottoms of slats 30 and covers the space between the bottom of slats 30 and base slat support 22 (not shown in FIG. 3). The functional importance of base front 20 in concealing springs which provide upward lift to slats 30 is shown in FIG. 5.

FIG. 4 shows a rear view of shutter 100 with slats 30 in the closed position. All slats 30 are of uniform size and shape and in the closed position, slats 30 present a flat surface in the same plane when closed and viewed from the rear. Top rear 48 is the area available for covering the gap between rear edge 54 of top 40 and the arched wall of the window to which shutter 100 is to be installed.

FIG. 5 shows a detailed view of slats 30 joined to base slat support 22. Springs 36 are positioned between slats 30 and base slat support 22. Springs 36 provide upward pressure on slats 30 so that slat top 39 (see FIG. 6) will touch top support 50 (see FIGS. 2 and 3). Springs 36 are hidden by base front 20 and base rear 24 (see FIGS. 1, 2,3 and 4).

Figure 6:
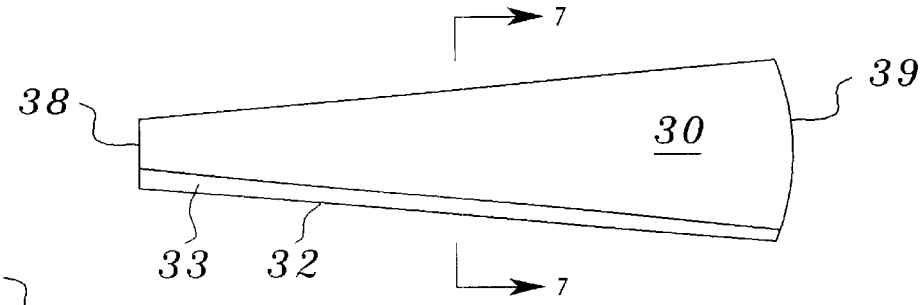
FIG. 6 provides a view of a single slat.

FIG. 6 is a front view of slat 30. Slat 30 has first edge 32 and slat first ridge 33. Slat 30 also has slat second edge 34 and slat second ridge 37 (see FIG. 7). Slat 30 has slat top 39 and slat bottom 38.

Figure 7:
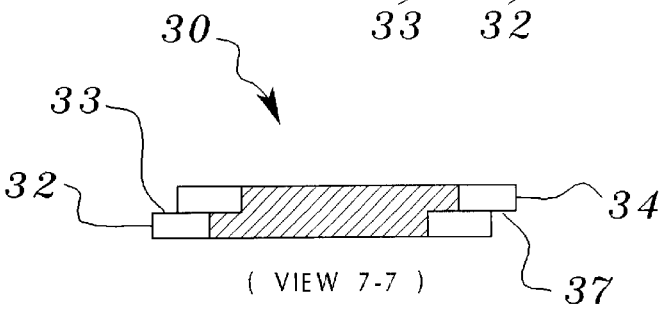
FIG. 7 provides a cross section view along line 7—7 of FIG. 6.

FIG. 7 is a cross sectional view of slat 30 along line 7—7 of FIG. 6. Slat 30 has slat second edge 34 and slat first edge 32. Slat first edge 32 has slat first ridge 33 and slat second edge 34 has slat second ridge 37. The purpose of slat first ridge 33 and slat second ridge 37 is that when the slats are turned parallel to each other the edges will engages one another and minimize leakage of light between the slats. Slat first ridge 33 of slat 30 will engage slat second ridge 37 on the adjacent slat 30.

Figure 8:
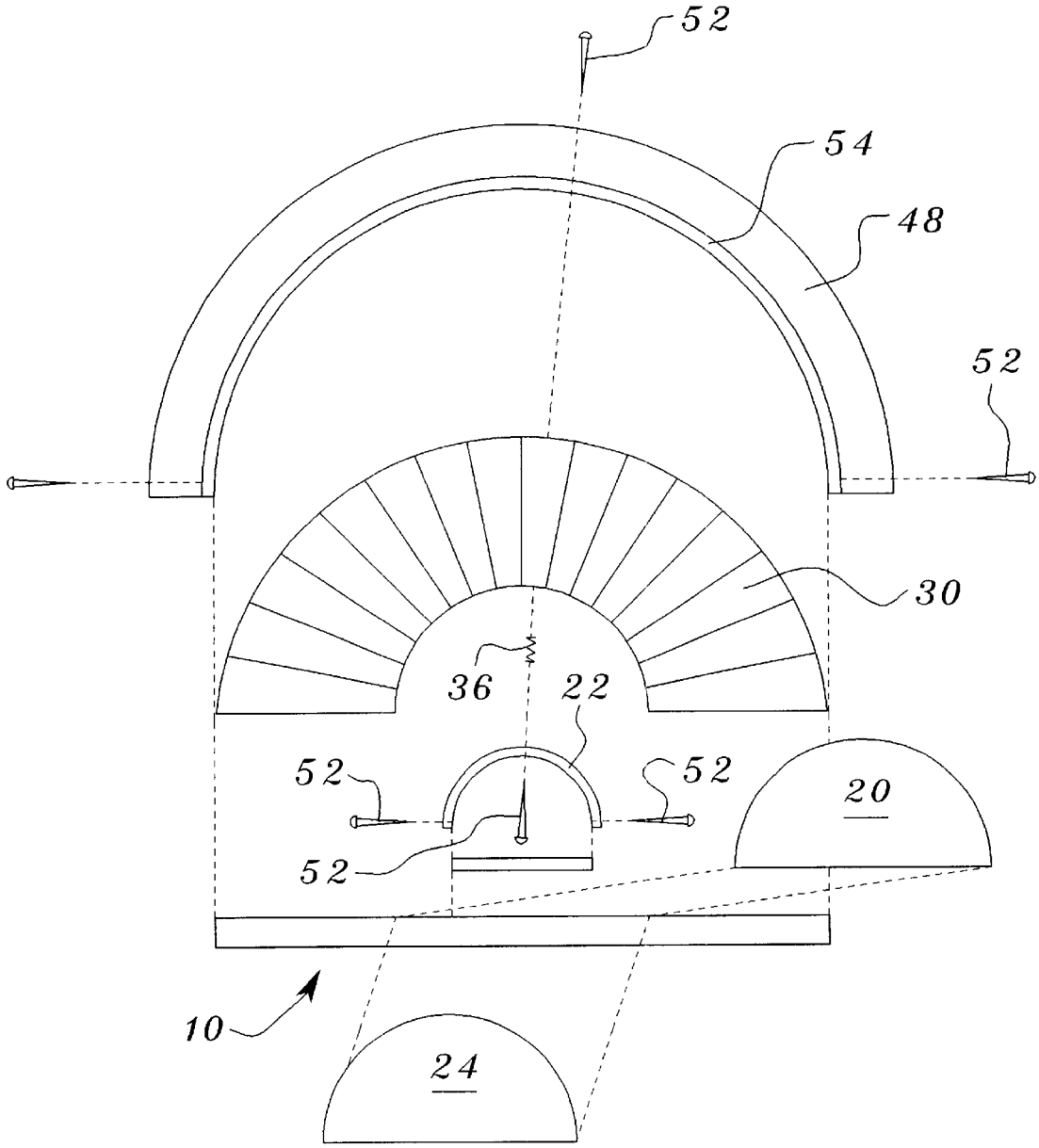
FIG. 8 shows an exploded view of the apparatus.

FIG. 8 is an exploded view of shutter 100 as seen from the rear showing the assembly of shutter 100. Slats 30 are affixed to top 40 and base slat support 22 by securement devices 52. Securement device 52 is inserted through a hole in top support 50 and into slat top 39. Securement device 52 is placed though hole in base slat support 22, spring 36 is placed over securement device 52 and securement device 52 is affixed to slat bottom 38. In the preferred embodiment, securement device 56 is a screw which is affixed to slat bottom 38 by being screwed into slat bottom 38 and which has a head which prevents the screw from passing completely through slat support 22. Persons skilled in the art are aware of a variety of securement devices such as dowels, screws, nails, rods and bolts. Spring 36 keeps slat 30 in position up against top support 50 thereby minimizing light leakage between slat top 39 and top support 50. In addition, spring 36 maintains slat 30 in position by friction between slat top 39 and top 40 so that when each slat 30 is turned individually, each slat 30 will remain in the position to which it was turned. The process is repeated for each slat 30. When all slats 30 have been affixed to base slat support 22 and top support 50, stiffener 18 is placed between base slat support 22 and baseboard 16 so that the ends of base slat support will go over the ends of stiffener 18 and base slat support 22 in glued to baseboard top surface 14 of baseboard 16. Stiffener 18 prevents warping of baseboard 16. Base front 20 is then glued to base slat support 22 and baseboard top surface 14. Base rear 24 is then glued to base slat support 22 and baseboard top surface 14. Base front 20 and base rear 24 conceal slat bottoms 38 and springs 36.

Figure 9:
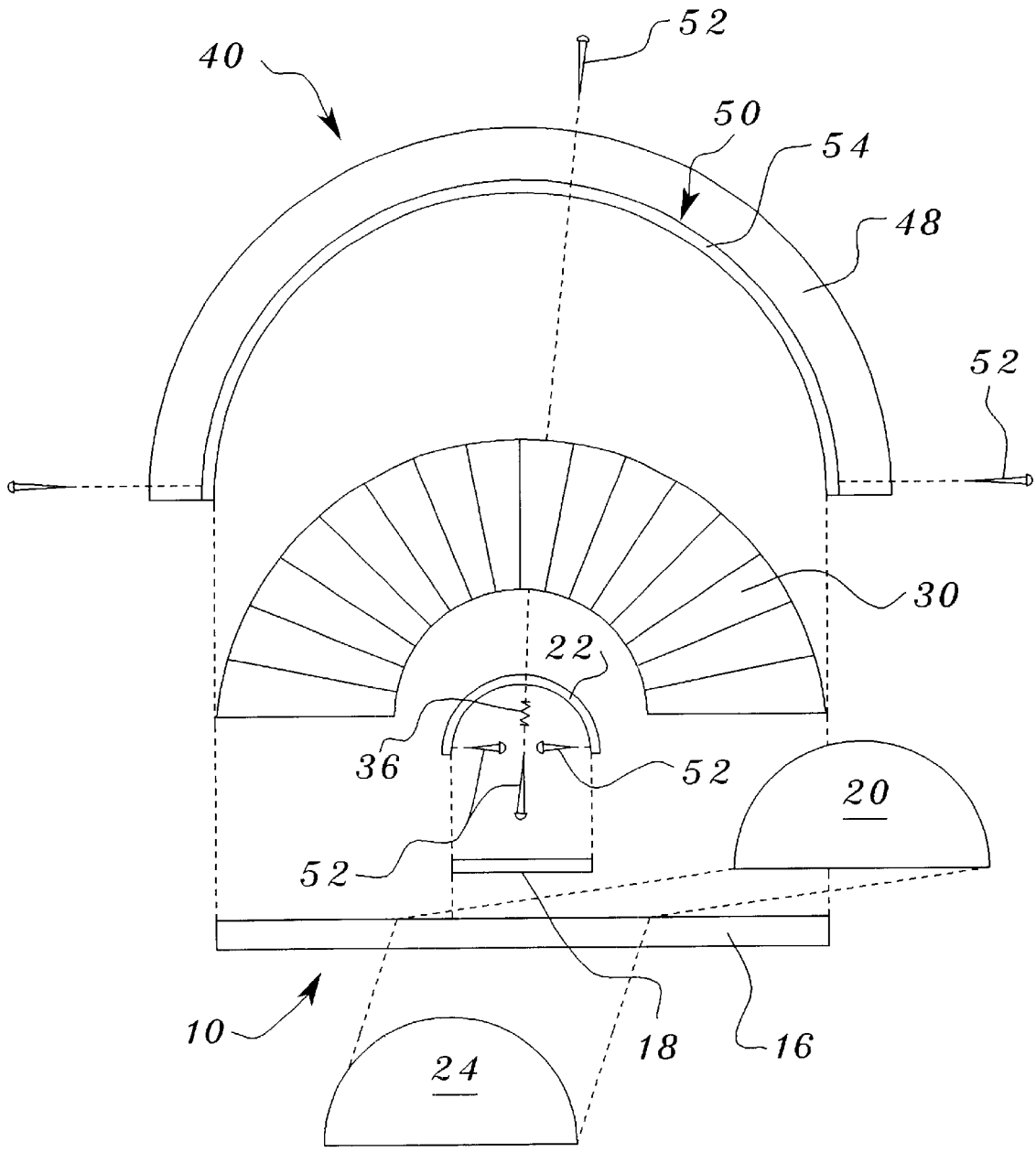
FIG. 9 shows an exploded view of the apparatus with variation.

FIG. 9 shows an alternative placement of springs 36 where springs 36 are placed beneath base slat support 22 so that downward pressure is exerted on securement device 56. Springs 36 exert sufficient downward pressure to cause slats 30 to remain in any position to which they are manually turned due to friction between slat bottom 38 and base slat support 22.

Further in the alternative, springs 36 may be placed to provide upward pressure on slats. 30. In order to position springs 36 so that upward pressure on slats 30 is exerted, springs 36 are not placed between securement device 56 and base slat support but are placed in a manner to provide upward pressure on securement device 56. Such manner of placement includes but is not limited to stapling of spring 56 to the bottom of base slat support 22 so that springs 36 are held in position and in compression to exert upward force against securement device 56 which in turn exerts upward pressure on slat 30. Alternatively, a spring cover (not shown) may be affixed to base slat support 22 by screws, nails of adhesive so that springs 36 are held in position and in compression to exert upward force against securement device 56 which in turn exerts upward pressure on slat 30. Therefore, when spring 36 is positioned beneath base slat support 22 so that upward pressure is exerted on slat 30, spring 36 maintains slat 30 in position by friction between slat top 39 and top 40 so that when each slat 30 is turned individually, each slat 30 will remain in the position to which it was turned.

In an alternative embodiment, base 10 is comprised of a split baseboard (see FIG. 10 below) so that stiffener 18 and base slat support 22 fit between two baseboard sections. Construction with a split base board brings a portion of the bottom slat 30 on the right and left side of base slat support 22 between the two baseboard sections and below the level shown for baseboard 16 in FIG. 8. Construction with a split baseboard allows an increase in the size of the surface area of top rear 48 and top front 42 (see FIG. 1) which increases the range of window arches to which one size of shutter 100 can be affixed.

Figure 10:
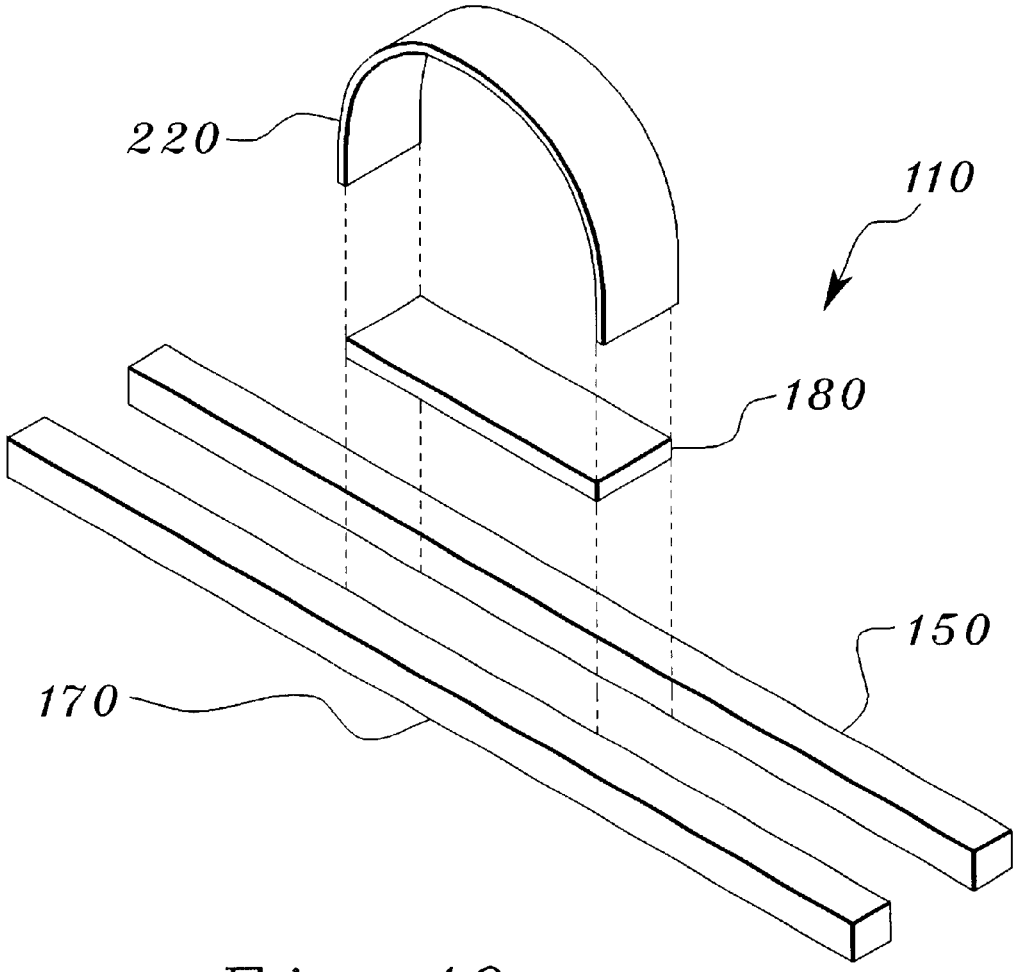
FIG. 10 shows a split baseboard alternative embodiment-line.

FIG. 10 depicts the split baseboard alternative embodiments 110 showing a split baseboard configuration having left split baseboard 170 and right split baseboard 150. Base slat support 220 and stiffener 180, can be seen extending down into the space between left split baseboard 170 and right split baseboard 150.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed:

1. A shutter for a semi-circular window opening having an arched wall comprising:

a top having a top rear, a rear edge and a top support affixed to said top rear;

a plurality of slats each having a top end and a bottom end;

an arched base slat support affixed to a baseboard;

a plurality of springs affixed to said base slat support and to the bottom ends of said slats;

a base front affixed to the base slat support and adapted for minimizing light leakage at the bottom ends of the slats;

a base rear affixed to the base slat support;

a plurality of first securement devices;

a plurality of second securement devices;

a stiffener disposed within said base slat support between opposing ends of the base slat support;

wherein said stiffener prevents warping of said baseboard;

wherein said springs are partially concealed by said base front and the base rear;

wherein said plurality of top ends are affixed to said top support by said plurality of first securement devices; and wherein said plurality of springs are affixed between said plurality of bottom ends and said base slat support by said plurality of second securement devices; and wherein an area of the top rear is adapted for covering a gap between said rear edge and said arched wall.

2. The shutter of claim 1 wherein each of said slats comprises a first ridge and a second ridge; and wherein when said slats are in a closed position the first ridge of one of said slats will engage the second ridge of an adjacent one of said slats.

3. The shutter of claim 1 wherein said first securement devices and said second securement devices comprise screws.

4. The shutter of claim 1 wherein said first securement devices and said second securement devices are selected from the group consisting of nails, dowels, bolts and rods.

5. The shutter of claim 1 further comprising a plurality of joints comprising angled metal brackets wherein said top rear is fixedly engaged to said top support by said joints.

6. A shutter for a semi-circular window comprising:

a top having a top rear, a top front and a top support affixed to said top rear;

a plurality of slats each of said slats having a top end, a bottom end, a first ridge and a second ridge;

an arched base slat support;

a split baseboard having a first baseboard section and a second baseboard section;

a plurality of springs;

a plurality of first securement devices;

a plurality of second securement devices;

a base front affixed to said base slat support and adapted for minimizing light leakage at the bottom ends of the slats;

a base rear affixed to said base slat support;

a stiffener fixedly engaged to said first baseboard section, said second baseboard section and said base slat support;

wherein said stiffener is disposed between opposing ends of said base slat support;

wherein, said top ends are affixed to said top support by said plurality of first securement devices;

wherein said first ridge of one of said slats engages the second ridge of an adjacent one of said slats when said slats are in a closed position;

wherein said base slat support extends downward between said first baseboard section and said second baseboard section.

7. The shutter of claim 6 wherein said first securement devices and said second securement devices comprise screws.

8. The shutter of claim 6 wherein said first securement devices and said second securement devices are selected from the group consisting of nails, dowels, bolts and rods.

9. The shutter of claim 6 further comprising a plurality of joints comprising angled metal brackets wherein said top rear is fixedly engaged to said top support by said joints.

* * * * *